US007018516B2

(12) United States Patent
Gnann et al.

(10) Patent No.: US 7,018,516 B2
(45) Date of Patent: Mar. 28, 2006

(54) BIPOLAR MULTI-PURPOSE ELECTROLYTIC CELL FOR HIGH CURRENT LOADS

(75) Inventors: Michael Gnann, Pullach (DE); Wolfgang Thiele, Eilenburg (DE); Gerd Heinze, Eilenburg (DE)

(73) Assignee: Peroxid-Chemie GmbH & Co. KG, Pullach (DE)

( * ) Notice: Subject to any disclaimer, the term of this patent is extended or adjusted under 35 U.S.C. 154(b) by 299 days.

(21) Appl. No.: 10/258,386

(22) PCT Filed: May 9, 2001

(86) PCT No.: PCT/EP01/05344

§ 371 (c)(1),
(2), (4) Date: Feb. 11, 2003

(87) PCT Pub. No.: WO01/86026

PCT Pub. Date: Nov. 15, 2001

(65) Prior Publication Data

US 2003/0150717 A1 Aug. 14, 2003

(30) Foreign Application Priority Data

May 9, 2000 (DE) ..... 100 22 592

(51) Int. Cl.
*C25B 9/06* (2006.01)
*C25B 1/28* (2006.01)

(52) U.S. Cl. ..... 204/254; 204/255; 204/263; 204/288.1; 204/244; 204/245; 205/334; 205/383; 205/496; 205/473; 205/474

(58) Field of Classification Search ..... 204/254–257, 204/262–269, 290 R; 428/166, 167; 205/377, 205/383, 465
See application file for complete search history.

(56) References Cited

U.S. PATENT DOCUMENTS 2,477,139 A * 7/1949 Patton ..... 384/280
5,082,543 A * 1/1992 Gnann et al. ..... 204/255

FOREIGN PATENT DOCUMENTS

EP 0 500 505 A 8/1992
WO WO-93 202 61 A 10/1993

* cited by examiner

*Primary Examiner*—Roy King
*Assistant Examiner*—Lois Zheng
(74) *Attorney, Agent, or Firm*—Fulbright & Jaworski L.L.P.

(57) ABSTRACT

A bipolar multi-purpose electrolytic cell for high current loads has a frame, two electrode edge plates with metal electrode sheet, and power supply and of bipolar plates. Each includes a plastic electrode base body with electrode rear spaces and/or with coolings spaces that are incorporated on one or both sides: incorporated supply and discharge lines for the electrolyte solutions and the cooling medium, metal electrode sheets which are applied to both sides of the base body and are solid and/or perforated in the electrochemically active area: electrolyte sealing frames, which rest on the solid metal electrode sheets and which are made of flexible plastic, and: ion exchanger membranes, which rest on the perforated metal electrode sheets and/or on the electrolyte sheets and/or on the electrolyte sealing frames and which are provided for separating the electrode spaces.

17 Claims, 4 Drawing Sheets

BIPOLAR MULTI-PURPOSE ELECTROLYTIC CELL FOR HIGH CURRENT LOADS

BACKGROUND AND SUMMARY OF THE INVENTION

Figure 1A:
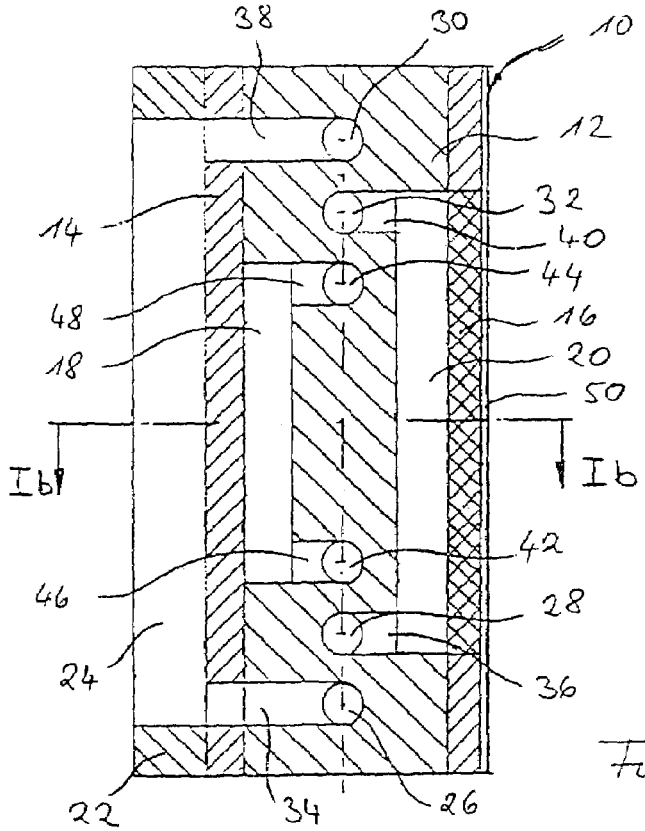

The invention relates to a multipurpose electrolysis cell which is bipolar-connected and is of high strucutral form for preferably high current loads of between 1 and 10 kA/m$^2$ per individual bipolar cell. If the materials for the electrodes and the other cell assemblies are suitably adapted to the materials system in question, it can be used both in environmental technology for the electrochemical breakdown of inorganic and organic pollutants and in the chemical and pharmaceutical industry for producing inorganic and organic products. A particular application involves the production of peroxodisulphates and perchlorates.

Bipolar electrolysis cells of filter press design, comprising a clamping frame, the two electrode edge plates with supply conductors and any desired number of bipolar electrode plates, as well as peripheral equipment for supplying and discharging the electrolyte solutions and the cooling or temperature-control medium, are known in numerous forms and for a very wide range of applications. They may be of undivided form or may be divided into two-chamber or multichamber cells by means of ion exchange membranes or microporous diaphragms. The electrode or electrolyte spaces required can be designed as separate assemblies or may be integrated in the electrode edge plates or in the bipolar electrode plates.

Compared to the monopolar electrolysis cells which are of similar design, in filter press form, the considerable advantage of the bipolar electrolysis cells is that the current supply from the outside only has to be brought to the two edge plates, while the current transport in the individual bipolar cells takes place only from one side of the electrode plate to the other side, generally internally. For the most part, a simple bipolar electrode plate in which anode and cathode side consist of the same electrode material is not sufficient. In many cases, especially for multipurpose electrolysis cells, it is necessary to provide anodes and cathodes from different materials, preferably consisting of metal sheets. These can then be directly or indirectly connected to one another in an electrically conductive manner via contact bodies.

One possible embodiment of a bipolar multipurpose electrolysis cell of this type with a high height-to-width ratio which is required here, in order to achieve the "gas lift effect" for electrolyte circulation, as part of a gas lift electrolysis and reaction system which is of versatile design and can be used for a wide variety of purposes, is described in DE 44 38 124. This document describes an electrolysis cell structure which is optimized with a view to utilizing the lift provided by the evolved gases, with an overall height of 1.5 to 2.5 m. The bipolar electrode plates comprise electrode base bodies made from impregnated graphite or from plastics with feed and discharge lines machined in for the electrolyte solutions and the cooling medium, and electrodes and electrolyte spaces which are applied on both sides or, in the case of the graphite base bodies, are also integrated.

In this arrangement, the two electrodes, in the case of the graphite base bodies, are connected to one another in an electrically conductive manner via the latter, and in the case of the plastic base bodies are connected to one another in an electrically conductive manner by inserted contact elements. Such contact elements are arranged within the sealing surfaces which are covered by electrolyte frames made from elastic material. The contact is made as a result of the pressure during assembly.

Contact elements of this type arranged inside the plastic base bodies in the region of the sealing frames have drawbacks and risks particularly with high current intensities which are to be transmitted. For example, there is a risk of individual contact elements overheating, thus causing the entire bipolar unit to fail. The electrode base body, which is preferably made from thermoplastics, begins to soften at the overheated points, the pressure on the contacts drops and the inevitable result is an overload on the other contact elements. A further consequence may be melting of the baseplates, electrical spark-overs, uncontrolled discharge of electrolyte and also possible explosions as a result of the electrolysis gases then mixing. At any rate, the failure of a bipolar unit as a result of contact damage of this nature inevitably means the entire filter press cell is then out of action. The risk of such failure increases as the current load on the individual contact elements rises, the softening point of the plastic base bodies used decreases and the electrolyte temperature required rises.

A further drawback of internal contacts of this type is that in the event of leaks in the sealing system, electrolyte enters the press contact, where it leads to uncontrollable corrosion phenomena. This corrosion likewise causes the electrolysis cell to fail or be destroyed.

Therefore, bipolar electrolysis cells of this type with plastic base bodies have hitherto only gained acceptance for low to medium current loads of 100 to 1000 A and for low working temperatures.

It was also possible to eliminate these difficulties by dispensing with the use of plastic base bodies of this type. However, compared to the designs with plastic base bodies, the transition to one of the known all-metal designs for bipolar electrolysis cells, for example with both metal electrode sheets or cathodic and anodic half cells connected in an electrically conductive manner by screw connections to form the corresponding bipolar units also entails a number of drawbacks. For example, minimizing the current losses between the individual cells which are at different voltage levels and are connected to one another by the electrolyte lines requires special measures, since the electrical resistance in the connection lines for the electrolyte solutions is significantly lower than if electrically insulating plastic base bodies with the machined-in feeds and discharges for the electrolyte solutions are used.

In the numerous electrolysis cells which have been described hitherto, the electrodes used normally cannot be employed as metal electrode sheets which are simple to manufacture and are therefore also easy to exchange as part of a multipurpose cell. As soon as cooling channels or, when using perforated electrodes, electrolyte back spaces are required, welded designs are generally inevitable for the two half-cells, which often consist of different electrode materials or material combinations, of a bipolar unit. Particularly in the case of high-quality electrode materials and/or electrode materials which are difficult to process, the outlay on equipment involved in this is relatively high. Since the electrical contact between the two half-cells of the bipolar units is generally effected by a multiplicity of screw connections, assembly is significantly more complex than that of the cell designs in which this contact can be produced automatically by clamping together. Also, the transition to different electrode materials generally requires an altered design which is adapted to the materials properties.

An electrolysis cell for high current loads which is of monopolar design is described in DE 39 38 160.

The monopolar design has the fundamental drawback that a large number of individual cells have to be connected in series in order to approach a favourable voltage range for the current transformation (e.g. 200 V).

The electrolyte-side and current-side connection leads to high costs of the design.

A further drawback of the cells described is the design as a hollow body.

The abrasion of the active coating of the anode means that the entire anode body has to be manufactured again as new. The same applies to the cathode.

The pressing of the electrode hollow bodies causes deformation of the latter, and since they have no internal support (this would be extremely difficult to achieve in manufacturing technology terms), this leads to the electrodes being insufficiently plane-parallel. In extremis, this may lead to short circuit and therefore to the cell being destroyed and exploding.

These problems become more intense as the size of the cell increases and mean that only relatively small embodiments are produced, leading to high construction and operating costs with the drawbacks which have been outlined.

The desired versatile multipurpose electrolysis cell for high current loads can therefore scarcely be achieved on this basis.

The invention is therefore based on the problem of providing a bipolar multipurpose electrolysis cell which is constructed according to the filter press principle and has electrode base bodies which are made from plastic and in which good, operationally reliable contacting of the metal electrode sheets is ensured even at high current loads, while avoiding the drawbacks which have been outlined of the known technical solutions.

According to the invention, this problem is solved in the following way by the invention described in the patent claims: supply conductor plates and bipolar electrode plates with a height-to-width ratio of 30:1 to 1.5:1, preferably 10:1 to 1.5:1, are used, in which the metal electrode sheets and the electrolyte sealing frames project laterally beyond the electrode base bodies made from plastics and are connected both to vertical contact rails, which are arranged on both sides at a distance of 1 to 50 mm, preferably 5 to 50 mm from the electrode base bodies and, in the region of the electrolyte sealing frames, to the electrode base bodies, to form mechanically stable, bipolar electrode plates which can be fitted as independent units, the electrical contact between electrode plates and contact rails and the electrical insulation of two adjacent bipolar units with respect to one another being brought about by the electrolyte sealing frames, with simultaneous sealing of the electrolyte spaces when the electrode plates are clamped by means of the clamping frame as a result of the pressure. To maintain cell elements which can be handled individually, the cathode and anode sheets of a bipolar element are expediently screwed to the corresponding contact rails on one or both sides by means of countersunk head screws. This screw connection serves only to improve handling, however, and is to only a small extent responsible for the current flow, which is primarily optimized by the pressure of contact.

Since, therefore, the current contact is separated by an air gap from the electrolyte-carrying cell frame, leaks in the sealing system do not lead to the supply conductor failing in the medium term, since any electrolyte which escapes is drained, and as a result leaks of this type can be detected and remedied in good time.

In the case of the anode sheets, the metal electrode sheets consist of valve metals, preferably of titanium, which in the electrochemically active region are coated in a known way by active layers of precious metals, precious metal oxides, mixed oxides of precious metals and other metals, and other metal oxides, such as for example lead dioxide. Alternatively, other valve metals, such as tantalum, niobium or zirconium, may also be considered as supports for active layers of this type. However, lead-plated, nickel-plated, copper-plated steel or nickel-base alloys may also be suitable for particular applications.

In a particularly preferred embodiment, the anode sheets have a precious-metal application of solid platinum and are obtainable by hot isostatic pressing of platinum foil and titanium sheet.

The cathode material used is preferably stainless steel, nickel, titanium, steel or lead. Within the context of the present invention, cathodes made from high-alloy stainless steels of materials No. 1.4539 are preferably used, with an active electrode surface designed as expanded metal and resting on the back side directly on the perforated cathode frame part serving as a support.

The term perforated metal electrode sheets is to be understood as meaning in particular metal electrode sheets made from expanded metals. However, metal sheets which have been perforated in some other way or slatted electrodes may also be suitable.

The contact rails used are preferably contact rails made from copper, which may be tin-plated or silver-plated on the contact surfaces or may be coated with precious metals. The current contact surfaces of the electrodes are preferably provided with coatings of good conductivity, such as for example layers of platinum, gold, silver or copper, applied, for example by electrodeposition. The contact rails and the electrode contacts are preferably gold-plated or platinum-plated, and the current is transmitted as a result of the pressure contact formed as a result of clamping of the electrode assembly.

The design solution according to the invention, with contact rails which are arranged outside the plastic base bodies but still inside the clamping frame, however, can be utilized optimally for electrolysis cells of high current load and when using electrode materials which are expensive and/or of poor conductivity only if the high and narrow structural form according to the invention, preferably with a height of 1.5 to 3 m and a height/width ratio of 10:1 to 1.5:1 of the electrode plates is employed. Although similar cell dimensions have repeatedly been proposed for gas lift cells, in these cases it has only been with a view to optimizing the lift provided by the evolved gases in order to obtain a maximum gas lift effect.

In the present case, in combination with the contact according to the invention, the following advantages are produced even with electrodes without gas evolution: firstly, for an identical width of the contact rails, the contact area available proportional to the cell height rises, with the result that lower thermal loads are imposed on the contacts. However, the current transport from the contact surfaces through the metal electrode sheets is also promoted, since, for the same active electrode area, the same thickness of the electrode sheets and the same current load, the cross section, which is the determining factor for current transport, rises with the height of the electrode plates and, at the same time, the distance for current transport is reduced as the height increases. Under these boundary conditions, the electrical resistance falls and therefore the voltage drop in the electrode sheets falls by the square of the cell height. Therefore, with the same permissible voltage drop, with the narrow and high electrode plates which are to be used according to the invention it is possible to employ electrode sheets which are significantly thinner or less electrically conductive or to use significantly higher current loads. This is of great importance in particular in the case of perforated electrode sheets, in which a reduction in the cross section for current transport has to be accepted. Also, in the case of fitting of the cell assembly with thin sheet electrodes, any undulation in the sheet after pressing is compensated for, so that the electrode is made plane-parallel.

As a result of copper tubes which are soldered onto the outside of the contact rails, the contacts can be kept at or below room temperature by means of cooling water even in the event of high current loads. In this way, heating of the cell frame, of the sealing system and of the current contacts and the associated problems such as deformation and overheating are completely avoided.

The electrodes being plane-parallel with respect to one another represent a precondition for high current yields and uniform electrode corrosion.

The fact that the electrode plates are mounted so that they can move freely (float) in the sealing frame in the cell design described means that clamping and thermal expansion does not lead to deformation and curvature of the electrodes, so that excellent parallelism is achieved, and this can be stabilized still further as a result of a reduced pressure, described below, being applied to the anode back side, in a particular embodiment.

Finally, the height of the cell plays a role in the cooling of the highly loaded contact rails.

This is because it has been found that, particularly at high electrolysis temperatures in the gaps which are open at the top and bottom, an air flow is formed between the plastic base bodies and contact rails, which result in cooling of the contacts and the metal electrode sheets which project laterally beyond the plastic base bodies. This cooling effect likewise increases significantly with the cell height both as a result of the "chimney effect" and as a result of the growing "cooling area".

It was thus possible to achieve the effect that the contacts, in particular at relatively high electrolyte temperatures, in a bipolar cell which is constructed according to the invention, adopt a significantly lower temperature than in the electrolysis cells with inner contact elements, in which, under comparable conditions, significantly higher temperatures are measured at the contact elements than in the interior of the cell. A further highly significant advantage of the distance between cell frame and contact web, which has already been mentioned, is that it is thus possible to drain off any small amounts of electrolyte which may escape. This is because if electrolyte penetrates into the contact gap, salt is formed and the contact deteriorates within a very short time.

A significant additional effect of the anode stabilization is achieved by the cooling medium.

The emerging cooling medium is taken off at a level below the height of the inlet. As a result, a reduced pressure, which can be adjusted by means of the level difference, is formed, and this pressure sucks the anode sheet onto the plastic base body and thus at the same time improves the plane-parallelism and prevents initial curvature of the anode in the event of pressure fluctuations in the cell. This measure makes it possible to achieve a very low electrode-to-electrode distance of 2 to 4 mm and therefore a low electrolyte. resistance and a high flow velocity.

The high flow velocity combined with a low mass throughput results in a high mass transfer to the anode surface, leading to a high yield of the anode product.

The invention is explained below on the basis of a plurality of exemplary embodiments and with reference to the appended drawings.

Figure 1B:
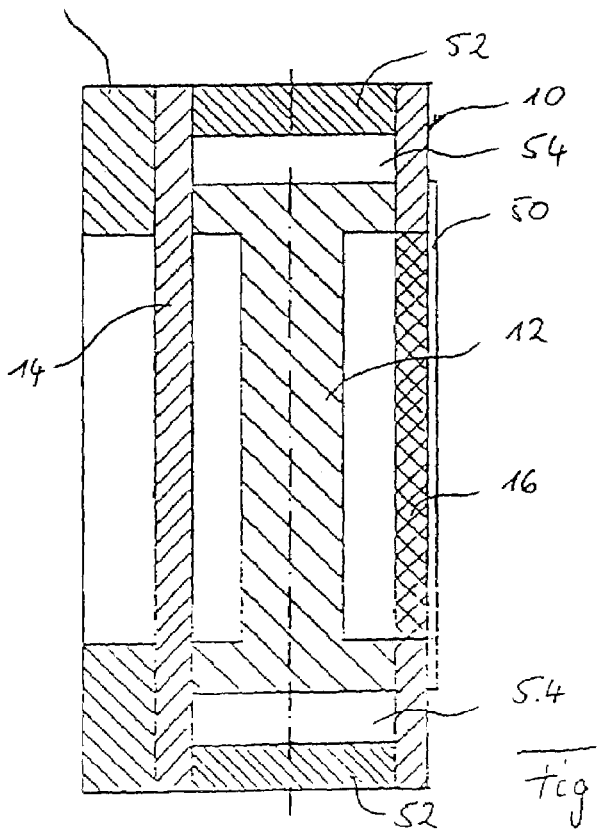

FIG. 1*a* shows a simplified vertical section through a first embodiment according to the invention with in each case one perforated and one solid metal electrode sheet, the latter cooled from the back side;

FIG. 1*b* shows a sectional view on line Ib—Ib in FIG. 1*a;*

Figure 2A:
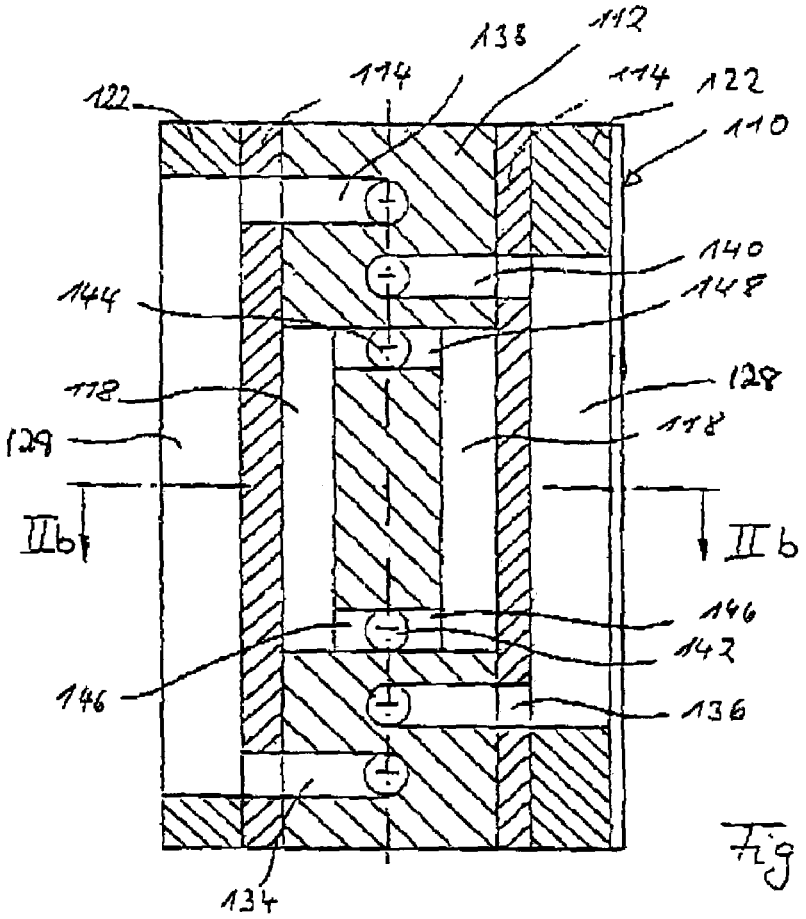

FIG. 2*a* shows a simplified vertical section through a second embodiment according to the invention, with two solid electrode sheets, both cooled from the back side.

Figure 2B:
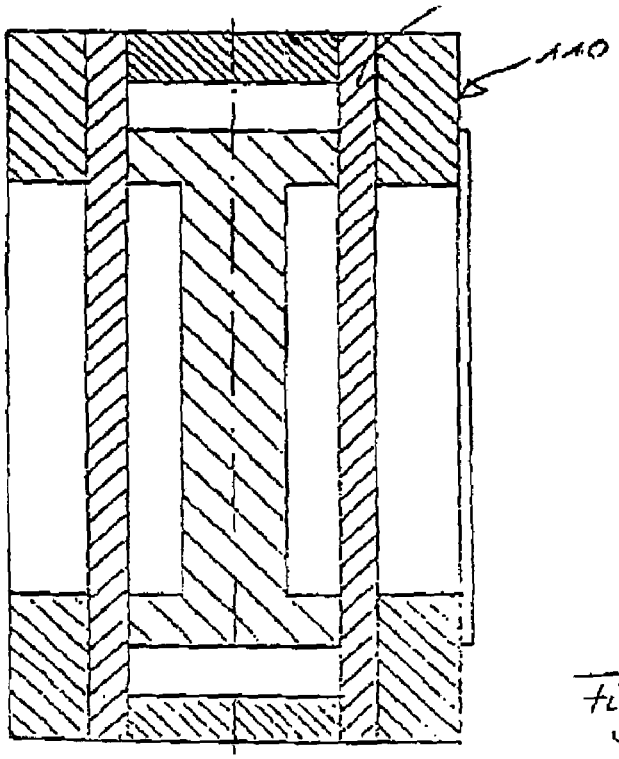

FIG. 2*b* shows a sectional view on IIb—IIb in FIG. 2*a;*

Figure 3A:
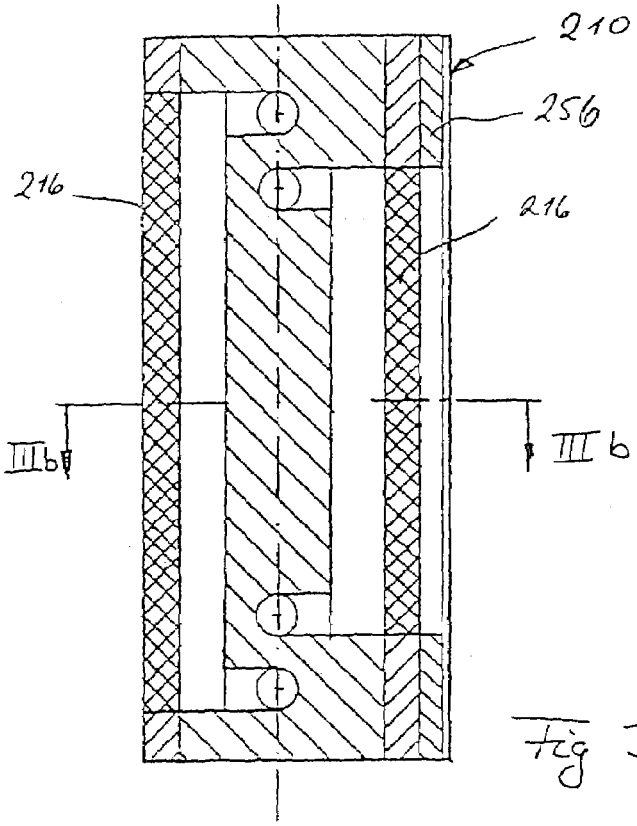

FIG. 3*a* shows a simplified vertical section through a third embodiment according to the invention, with two perforated metal electrode sheets and without additional cooling.

Figure 3B:
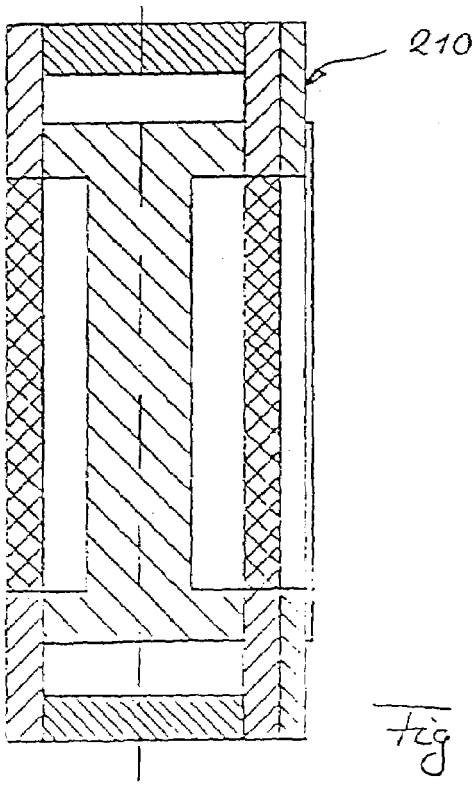

FIG. 3*b* shows a sectional view on line IIIb—IIIb in FIG. 3*a;*

Figure 4:
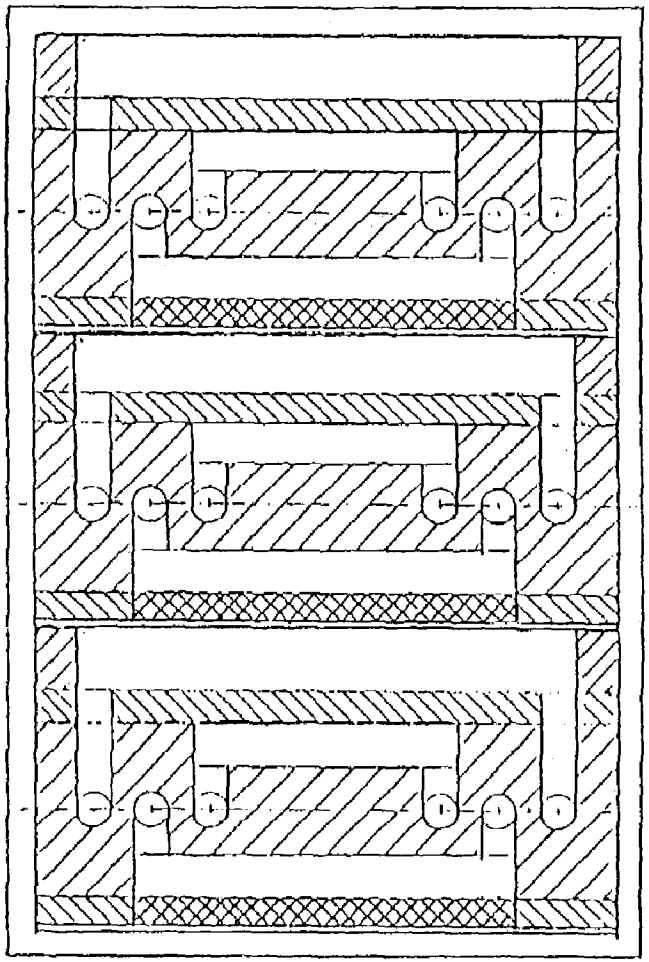

FIG. 4 shows a simplified vertical section through a bipolar electrolysis cell with three bipolar electrode sheets constructed as shown in FIG. 1*a* and has a clamping frame, which is illustrated in simplified form.

DETAILED DESCRIPTION

In all the embodiments, technical details, such as for example for the sealing system and the way in which the electrode sheets and contact rails are attached, have not been illustrated.

FIGS. 1*a* to 3*c* diagrammatically depict, by way of example, three embodiments of a split bipolar multipurpose electrolysis cell, in sectional illustrations through the electrochemically active regions, the upper figures representing side views and the lower figures representing plan views.

The bipolar multipurpose electrolysis cell as illustrated in its first embodiment in accordance with FIGS. 1*a* and 1*b*, in which figures it bears the reference numeral 10, is part of an electrolysis device (not shown). The bipolar multipurpose electrolysis cell 10 comprises an electrode base body 12 made from plastic, on both sides of which metal electrode sheets or electrode plates are arranged, and in this embodiment one electrode sheet 14 is solid and the other electrode sheet 16 is perforated in the electrochemically active region. The electrode base body 12 is double-T-shaped in cross section both in the vertical and the horizontal direction, with the result that channels 18, 20 are formed between the electrode base body 12 and the respective electrode sheets 14, 16. In addition, an electrolyte sealing frame 22 made from elastic material is arranged on the solid electrode sheet 14 and on the outer side of the solid electrode sheet 14, as seen from the electrode base body 12, forms a further channel 24. The channel 24 which is formed by the solid electrode sheet 14 and the electrolyte sealing frame 22 and the channel 20 which is formed between the electrode base body 12 and the perforated electrode sheet 16, this channel being referred to below as the electrode back space, serve to accommodate the electrolyte solutions for the electrolysis. The channel 18 which is formed between the electrode base body 12 and the solid electrode sheet 14 is used to accommodate cooling liquid to cool the solid electrode sheet 14 and, if appropriate, the electrode base body 12 and is referred to below as the cooling space.

Feed and discharge lines for the electrolyte solutions are machined into the electrode base body 12, the feed lines 26 and 28 being arranged in a lower central region of the electrode base body 12 and the associated discharge lines 30 and 32 being arranged in an upper central region thereof. The feed and discharge lines are connected to the electrolyte channels 24 and 20, through which the electrolyte solutions for the electrolysis are passed, via respective inlet openings 34, 36 and outlet openings 38, 40, the inlet and outlet openings 34 and 38 for the channel 24 formed on the solid electrode sheet 14 leading through the solid electrode sheet 14.

As has already been mentioned, a cooling space 18, into which or through which a cooling medium, in this case cooling water, can be passed or pumped, via feed lines 42 and discharge lines 44, which are arranged in a lower or upper central region, respectively, of the electrode base body 12, and corresponding connecting channels 46 and 48, is provided between the electrode base body 12 and the solid electrode sheet 14, in order to cool the electrode sheet 14. In this case, it is, of course, also possible to utilize a "lift effect", although cooling media in which a reverse effect occurs would also be conceivable. The perforated metal electrode sheet requires no additional cooling, since it is sufficiently cooled by the electrolyte solution and rests on the base body only in edge regions, thus avoiding a heat build-up.

An ion exchange membrane 50 rests on the perforated metal electrode sheet 16, being attached to the perforated electrode sheet 16 by suitable means.

Finally, the plan view given in FIG. 1*b* shows that contact rails 52 make contact with the laterally extended metal electrode sheets 14 and 16 and gaps 54, which are laterally delimited by the metal electrode sheets, are formed between the respective contact rails and the edge of the base body 12.

FIGS. 2*a* and 2*b* show a further embodiment of the invention. These figures illustrate a multipurpose electrolysis cell which is denoted by 110; components which correspond to those illustrated in the first embodiment shown in FIGS. 1*a* and 1*b* are provided with the same reference numerals, but in each case increased by 100. The text which follows only deals with the differences, so that otherwise reference can be made to the description of the first exemplary embodiment.

While in the first embodiment one solid electrode sheet 14 and one perforated electrode sheet 16 are used, in the second embodiment two solid electrode sheets 114 are used, on each of which an electrolyte sealing frame 122 rests. The inlet openings 134, 136 and outlet openings 138, 140 for the channels 128 formed on the solid electrode sheets 114 in this embodiment lead through both electrode sheets 114.

Cooling spaces 118 are provided on both sides of the base body 112 between the base body 112 and the electrode sheets, in order to cool the solid electrode sheets 114. The cooling spaces 118 are in turn supplied with cooling liquid via feed lines 142 and discharge lines 144 as well as corresponding connecting channels 146 and 148.

When using multipurpose electrolysis cells with two solid electrode sheets 114, in the clamped-in state, i.e. when a plurality of multipurpose electrolysis cells according to the invention are held together by clamping frames, a space grid is introduced between the membrane, which then lies in the centre between two sealing frames, and the cathode or anode surface, this grid preventing the membrane from resting on one of the electrode surfaces and ensuring an orderly flow of electrolyte. Spaces of this type are available in various forms for electrolysis purposes.

FIGS. 3*a* and 3*b* show a further multipurpose electrolysis cell according to the invention, which is denoted overall by 210, components which correspond to those shown in the first embodiment in accordance with FIGS. 1*a* and 1*b* being provided with the same reference numerals, but in each case increased by 200. Only the differences are dealt with below.

While in the first embodiment one solid electrode sheet 14 and one perforated electrode sheet 16 are used, in this embodiment two perforated electrode sheets 216 are used, a thin sealing frame 256, on which the ion exchange membrane 250 is attached by suitable means, being additionally arranged on one of the electrode sheets for the purpose of electrical insulation of these sheets. However, the ion exchange membrane 250 may also be arranged directly on an electrode sheet, in which case a thin sealing frame is attached to the membrane or the free electrode sheet. In this embodiment, the use of perforated electrode sheets alone means that cooling spaces are not required.

FIG. 4 illustrates the current transport through a cell consisting of three bipolar electrode plates, which are constructed according to the invention, and the two edge electrode plates with supply conductor on both sides and plastic base bodies which are widened to as far as the lateral contact rails.

The basis used was the design variant shown in FIG. 1*a* with one perforated metal electrode sheet and one solid metal electrode sheet per bipolar electrode sheet. The designations of the numbered components are the same as in FIG. 1.

The invention is not restricted to the design embodiments illustrated in FIGS. 1 to 4. For example, it is also possible to construct undivided cells or multichamber cells using the principle according to the invention. Microporous diaphragms can also be used instead of the ion exchange membranes. The feed and discharge lines for the electrolyte solutions may also be arranged differently from those illustrated here, for example they may lead out of the upper and lower end faces of the plastic base bodies or may lead as far as the edge plates via manifold lines inside the bipolar electrode plates.

What is claimed is:

1. An electrolysis cell for high current loads, comprising a clamping frame;

two electrode edge plates having metal electrode sheets and supply conductor; and bipolar electrode plates, said bipolar electrode plates comprising:

one electrode base body made from plastic, having at least one of cooling spaces and electrode back spaces which are machined in on one or both sides, machined-in feed and discharge lines for the electrolyte solutions and the cooling medium, metal electrode sheets which are applied to both sides of the base body and in the electrochemically active region are solid and/or perforated, electrolyte sealing frames which test on the solid metal electrode sheets and are made from elastic plastic, ion exchange membranes, which rest on the perforated metal electrode sheets and/or the electrolyte sealing frames, for separating the electrode spaces, characterized in that the electrode plates have a height-to-width ratio of 30:1 to 1.5:1, the metal electrode sheets and the electrolyte sealing frames project laterally beyond the electrode base bodies and are connected both to vertical contact rails, which are arranged on both sides at a distance of 1 to 50 mm from the electrode base bodies and, in the region of the electrolyte sealing frames, to the electrode base bodies, to form mechanically stable, bipolar electrode plates which can be fitted as independent units, the electrical insulation of two adjacent bipolar units with respect to one another being brought about by the electrolyte sealing frames, with simultaneous sealing of the electrolyte spaces when the electrode plates are clamped by means of the clamping frame as a result of the pressure wherein the electrolysis cell is a bipolar multipurpose electrolysis cell.

2. A cell according to claim 1, wherein said electrode sheets comprising anode sheets consisting of valve metals, preferably titanium, with active layers of precious metals.

3. A cell according to claim 1, wherein said electrode sheets comprising anode sheets have a precious-metal application of solid platinum, obtainable by hot isostatic pressing of platinum foil and titanium sheet.

4. A cell according to claim 1, wherein said electrode sheets comprising cathode sheet, wherein material of said cathode sheets is nickel, titanium, steel, or lead.

5. A cell according to claim 4, wherein said cathode sheets comprise a high alloy stainless steel with active electrode surfaces designed as expanded metal and resting on the back side directly on the perforated cathode frame part sewing as a support.

6. A cell according to claim 1, wherein said electrode sheets comprise anode sheets consisting of valve metals, preferably titanium, with active layers of precious metals.

7. A cell according to claim 1, wherein said electrode sheets comprise anode sheets having a precious-metal application of solid platinum, obtainable by hot isostatic pressing of platinum foil and titanium sheet.

8. A cell according to claim 1, wherein said electrode sheets comprise cathode sheets, wherein material of said cathode sheets is nickel, titanium, steel or lead.

9. A cell according to claim 1, wherein current contact surfaces of said electrode sheets are provided with coatings of platimun, gold, silver or copper layers.

10. A cell according to claim 6, wherein said electrode sheets comprise anode sheets having a precious-metal application of solid platinum, obtainable by hot isostatic pressing of platinum foil and titanium sheet.

11. A cell according to claim 6, wherein said electrode sheets comprise cathode sheets, wherein material of said cathode sheets is nickel, titanium, steel or lead.

12. A cell according to claim 7, wherein said electrode sheets comprise cathode sheets, wherein material of said cathode sheets is nickel, titanium, steel or lead.

13. A cell according to claim 8, wherein material of said cathode sheets is stainless steel.

14. A cell according to claim 8, wherein said cathode sheets comprise a high alloy stainless steel with active electrode surfaces designed as expanded metal and resting on the back side directly on the perforated cathode frame part serving as a support.

15. A cell according to claim 11, wherein material of said cathode sheets is stainless steel.

16. A cell according to claim 12, wherein material of said cathode sheets is stainless steel.

17. A cell according to claim 14, wherein said high-alloy stainless steel is material No. 1.4539.

* * * * *